US006971433B2

(12) United States Patent
Wagner et al.

(10) Patent No.: US 6,971,433 B2
(45) Date of Patent: Dec. 6, 2005

(54) AUTOMATIC RETRACTABLE AWNING

(75) Inventors: Robert Wagner, Longmont, CO (US); Garret Mauldin, Arvada, CO (US)

(73) Assignee: Carefree/Scott Fetzer Company, Broomfield, CO (US)

( * ) Notice: Subject to any disclaimer, the term of this patent is extended or adjusted under 35 U.S.C. 154(b) by 26 days.

(21) Appl. No.: 10/645,264

(22) Filed: Aug. 20, 2003

(65) Prior Publication Data

US 2004/0221965 A1 Nov. 11, 2004

Related U.S. Application Data

(60) Provisional application No. 60/469,276, filed on May 8, 2003.

(51) Int. Cl.[7] ..... E04F 10/06
(52) U.S. Cl. ..... 160/67; 160/69
(58) Field of Search ..... 160/67, 70, 69, 160/68, 66, 310, 22, 78, 79, 55, 65; 135/88.11, 88.12

(56) References Cited

U.S. PATENT DOCUMENTS 789,639 A * 5/1905 Thoms ..... 160/42
934,605 A * 9/1909 Goudie ..... 160/69
1,021,330 A * 3/1912 Price ..... 248/284.1
1,076,310 A * 10/1913 Pennington ..... 160/69
1,620,958 A * 3/1927 Girton et al. ..... 160/65
1,742,437 A * 1/1930 Davenport ..... 160/65
1,959,700 A * 5/1934 Anton et al. ..... 160/65
2,321,801 A * 6/1943 Dazzo ..... 160/69
3,779,302 A * 12/1973 Akers et al. ..... 160/68
3,847,171 A * 11/1974 Akers et al. ..... 160/68
6,095,221 A * 8/2000 Frey, Jr. ..... 160/67
6,273,172 B1 * 8/2001 Frey ..... 160/67
6,341,638 B1 * 1/2002 Thompson et al. ..... 160/67

* cited by examiner

*Primary Examiner*—David Purol
(74) *Attorney, Agent, or Firm*—Dorsey & Whitney LLP

(57) ABSTRACT

An automatically extendible and retractable awning includes an awning sheet mounted along one edge to a support structure and at an opposite edge to a roll bar about which it can be selectively wrapped. Each end of the roll bar is supported by a scissors type support structure allowing the awning to be extended and retracted in a simple but effective manner while allowing considerable space for movement of individuals around the awning.

13 Claims, 17 Drawing Sheets

AUTOMATIC RETRACTABLE AWNING

CROSS REFERENCE TO RELATED APPLICATIONS

This application claims the benefit of U.S. provisional application No. Ser. 60/469,276, filed 8 May 2003, which application is hereby incorporated by reference as if fully disclosed herein.

BACKGROUND OF THE INVENTION

1. Field of the Invention

The present invention relates generally to retractable awnings and more particularly to an automated and powered retractable awning that extends and retracts under its own power.

2. Description of the Relevant Art

Retractable awnings have been in use for many years, with early uses being primarily for covers for windows, doors, and the like. More recently, retractable awnings have also been designed for use on mobile structures such as recreational vehicles and mobile homes, and, accordingly, out of necessity, the awnings have needed to include more sophisticated systems for operation and for retaining the awnings in either retracted or extended positions. Further, awnings for recreational vehicles and motor homes are fairly long so as to extend along a substantial portion of the side of the vehicle, and, accordingly, they are relatively heavy and are sometimes difficult to manipulate. While some retractable awnings are specifically designed for use on mobile structures, they can also be used on residential or commercial buildings.

Typically, a retractable awning includes an awning sheet that is secured along one edge to the side of the recreational vehicle or the like, with the opposite edge being secured to a roll bar about which the awning sheet can be wrapped. The roll bars are rotatably supported at opposite ends by support arms which are conventionally telescoping in nature and have an inner end affixed to the sidewall of the vehicle at a relatively low location and beneath the connection of the awning sheet to the vehicle. Rafter arms are also normally provided which extend from the roll bar to a location on the side of the vehicle adjacent to the connection of the awning sheet to the vehicle, with the rafters typically being used to retain the awning sheet in a taut condition. The awning is moved from a retracted position adjacent to the side of the vehicle to an extended position by allowing the support arms to pivot about their connection to the side of the vehicle thereby allowing the awning sheet to unroll from the roll bar. After the awning sheet has been fully extended, the rafters are locked in position to retain a taut condition of the awning sheet, and subsequently, the support arms are telescopically extended causing the roll bar to move upwardly to a desired elevation.

The extension of the support arms has traditionally been difficult due to the heavy weight of the awning structure. The problem is compounded by the fact that many recreational vehicles are owned and operated by elderly individuals who do not always have the strength of younger individuals, and many times the elderly have some difficulty extending the awning to a desired elevation.

It will be appreciated from the above that while awnings are desirable not only in the recreational vehicle and mobile home industry but also on permanent residences and commercial buildings, they have been traditionally difficult to operate, thereby discouraging use of the awnings. Automated awnings have, therefore, been desirable and attempts to develop a reliable automatic awning have therefore been made. An example of such an automatic retractable awning is disclosed in U.S. Pat. No. 6,341,638, which is of common ownership with the present application.

Other problems with either automatic or manually operated retractable awnings include the fact that in most of these awnings, the support arms are connected to the support surface at a relatively low location so that as they extend away from the support surface, they inhibit the free flow of movement by individuals around the awning. Still another problem resides in the fact that most retractable awnings are braced and fixed in their extended condition so that water can accumulate on the awning sheet increasing the effective weight of the awning and possibly causing damage either to the awning hardware or the awning sheet itself.

It is to provide a dependable automatic awning and to overcome shortcomings in conventional manually and automatically operated retractable awnings that the present invention has developed.

SUMMARY OF THE INVENTION

The retractable awning of the present invention, like most retractable awnings of this type, has a flexible awning sheet or canopy that is secured along one edge to a support structure, such as the side of a recreational vehicle, mobile home, permanent residence, commercial building, boat, or the like. The opposite edge of the awning sheet is secured to a roll bar. When the awning is moved from an extended to a retracted position, the awning sheet is wrapped around the roll bar and conversely, when the awning is moved from a retracted to the extended position, the awning sheet is unwrapped from the roll bar. One end of the roll bar carries a reversible motor that can be electrically driven to rotate the roll bar in either direction with the motor being supplied with energy from either a battery or an AC power source.

The roll bar is supported by scissors-type support structures at both ends that extend from a support surface for the awning to an associated end of the roll bar.

The awning is extended or retracted by energizing the reversible motor in one direction or the other causing the awning fabric to unwrap from the roll bar or be wrapped around the roll bar as the case may be. As the awning fabric unwraps from the roll bar, the support structures are automatically extended to extend the awning. As the awning fabric is wrapped around the roll bar, it forces the support structures to retract as the awning moves toward its retracted position. In the retracted position, the support structures are folded neatly adjacent to the support surface and in the extended position, extend outwardly away from the support surface at a relatively high elevation so as not to impede the movement of people around the awning.

The support structures are also designed to yieldingly resist the weight of the awning and any material such as water that may accumulate on the awning sheet so that the awning will automatically dip under a predetermined amount of weight to allow water or the like to be automatically drained from the awning sheet.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENT

Figure 1:
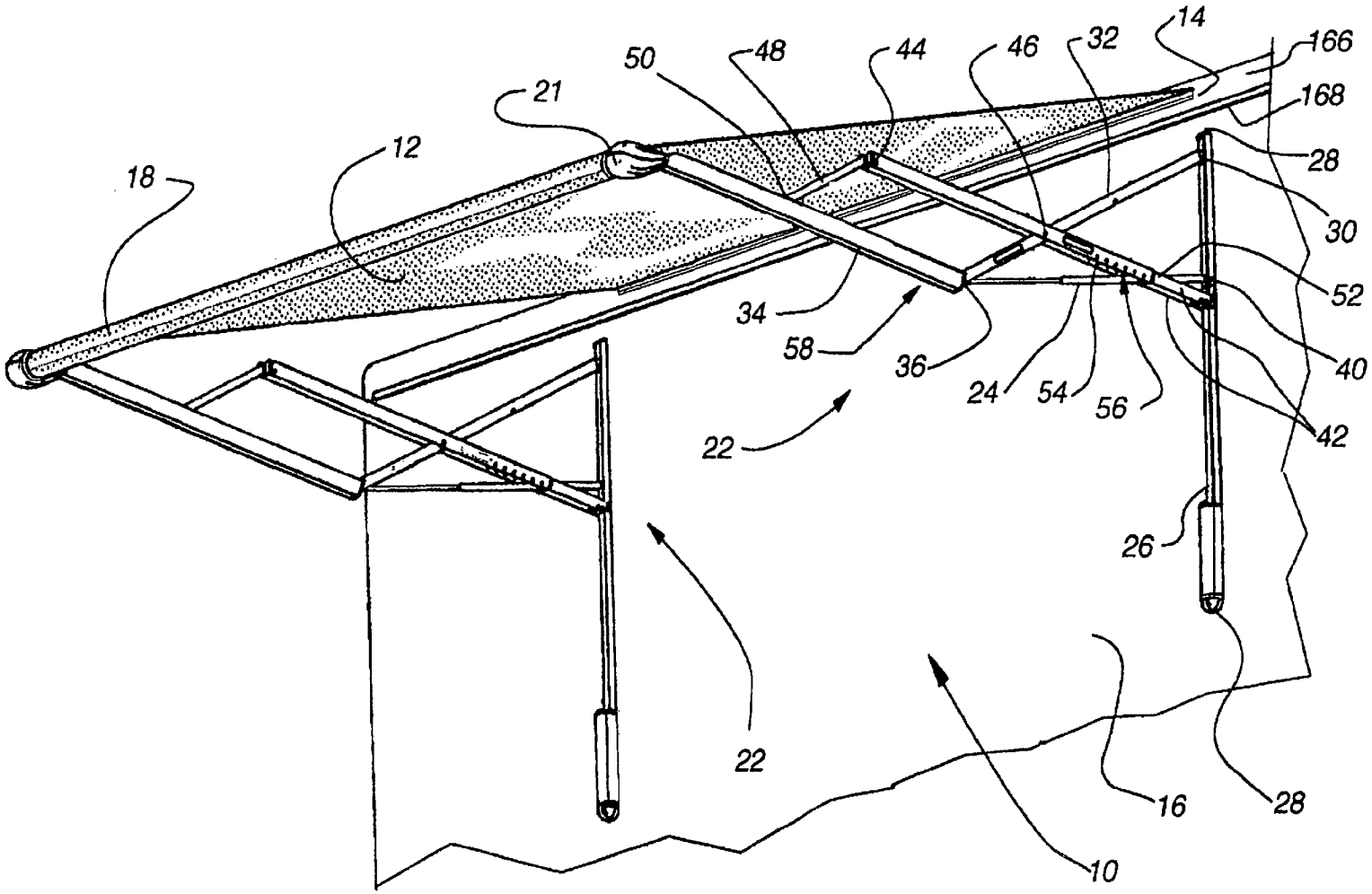
FIG. 1 is an isometric view of the awning of the present invention mounted on the side wall of a recreational vehicle in an extended position.

The retractable awning 10 of the present invention can be seen in FIG. 1 to include an awning sheet 12 anchored along its inner edge to a support rail 14 on a support surface 16 of a recreational vehicle and along an outer edge to a roll bar 18, even though the roll bar could be connected to the inner edge on the support surface and the outer edge to a movable lead bar if desired as would be apparent to those skilled in the art. The roll bar has a rotatable shaft (to be described in more detail later) that carries a reversible drive motor 20 (FIG. 30) at one end in a gear housing 21. The drive motor can be battery or AC powered depending upon the location of the awning and its access to electrical power. Each end of the roll bar is pivotally supported by an identical scissors-type support structure 22 which is adapted to automatically extend or retract as the awning is moved between retracted (FIGS. 3 and 9) and extended (FIGS. 1, 2, and 6) positions. The support structure is biased toward an extended position by a gas spring 24 that forms part of the support structure as will be described in more detail hereafter.

It will be appreciated that as the motor 20 is driven to rotate the roll bar in one direction, the awning sheet 12 is allowed to unwrap from the roll bar 18 and extend away from the support surface 16 upon which the awning is mounted with the support structures 22 automatically deploying or extending as the roll bar moves away from the support surface under the urging of the gas springs 24. Of course a reverse rotation of the motor causes the roll bar to rotate in an opposite direction affecting a wrapping of the awning sheet about the roll bar which collapses the support structures as they are moved toward their fully retracted position of FIGS. 3 and 9 and against the bias of the gas springs.

Figure 5:
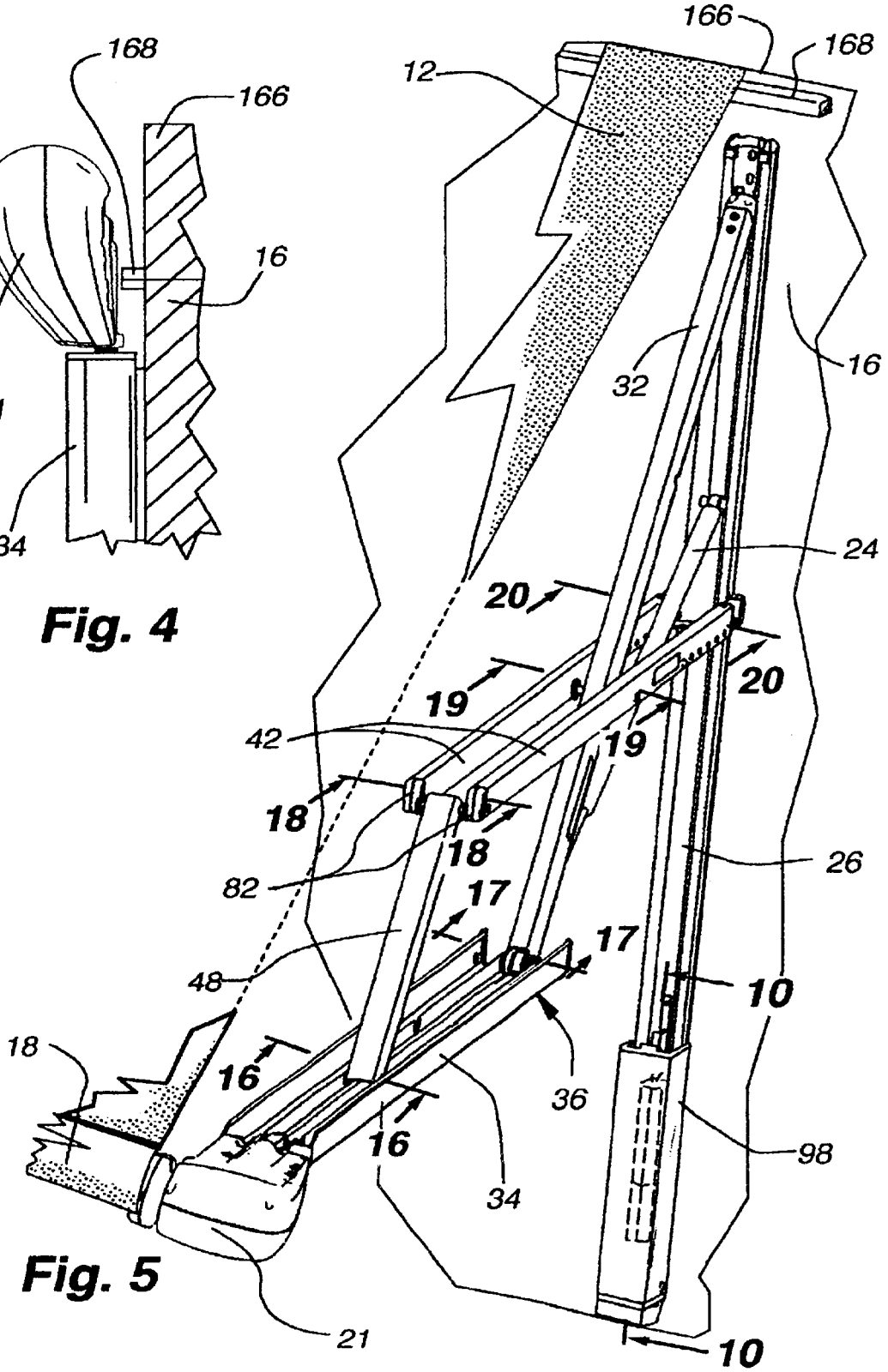
FIG. 5 is a fragmentary isometric looking at a support system at one end of the awning as it is mounted on the side wall of a recreational vehicle.

Each support structure 22 is identical and is best shown in FIG. 5. It will there be seen that each support structure includes a pair of spaced guide channels 26 held in a predetermined spaced relationship by upper and lower anchor brackets 28 with the brackets and guide channels anchored to the support surface 16 in a vertical orientation and at a spacing consistent with the width of the awning sheet 12. A horizontal pivot pin 30 is provided between the guide channels at the upper end thereof which pivotally supports the inner end of a fixed length inner brace arm 32 whose outer end is pivotally connected to the inner end of a fixed length outer brace arm 34 at an elbow joint 36. The outer end of the fixed length outer brace arm pivotally supports an associated end of the roll bar 18 through the gear housing 21 as shown in FIG. 1. The motor 20 is mounted in the gear housing as will become more clear later. An inner end of the gas spring is pivotally mounted on the support surface between the guide channels 26 with a mounting bracket 40. The outer end of the plunger for the gas spring is pivotally connected to the elbow joint 36. The gas spring is biased outwardly so as to bias or urge the elbow joint away from the support surface 16.

A pair of extendible brace arms 42 in each support structure have rollers 43 (FIG. 11) on their inner end and are retained in spaced parallel relationship by a pivot pin 44 at the outer ends of the extendible brace arms and by a pivot pin 46 at an intermediate location along their length. An auxiliary brace arm 48 is pivotally mounted at its inner end to the pivot pin 44 at the outer end of the extendible brace arms and has its outer end pivotally connected to the fixed length outer brace arm 34 by a pivot pin 50 at an intermediate location along the length of the fixed length outer brace arm.

Each extendible brace arm 42 includes inner and outer component parts 52 and 54 respectively which are telescopically related to allow relative longitudinal movement whereby the length of the extendible brace arm can be adjusted. A clamp member 56 is provided on each extendible brace arm to releasably secure the inner and outer telescoping parts in a selected longitudinal relationship thereby defining a desired releasably fixed length for the extendible brace arms. The brace arms 42 do not need to be adjustable but rather could be of a fixed length. The pivot pin 46 at an intermediate location along the length of the extendible brace arms retains the pair of extendable brace arms in a fixed separation while also pivotally supporting the fixed length inner brace arm 32 at an intermediate location along its length.

The interconnection of the extendible brace arms 42, the auxiliary brace 48, and the fixed length inner and outer brace arms 32 and 34 respectively form a parallelogram or scissors-type linkage 58 so that the auxiliary brace always remains parallel with the fixed length inner brace arm and the extendible brace arms remain parallel to the fixed length outer brace arm.

Figure 2:
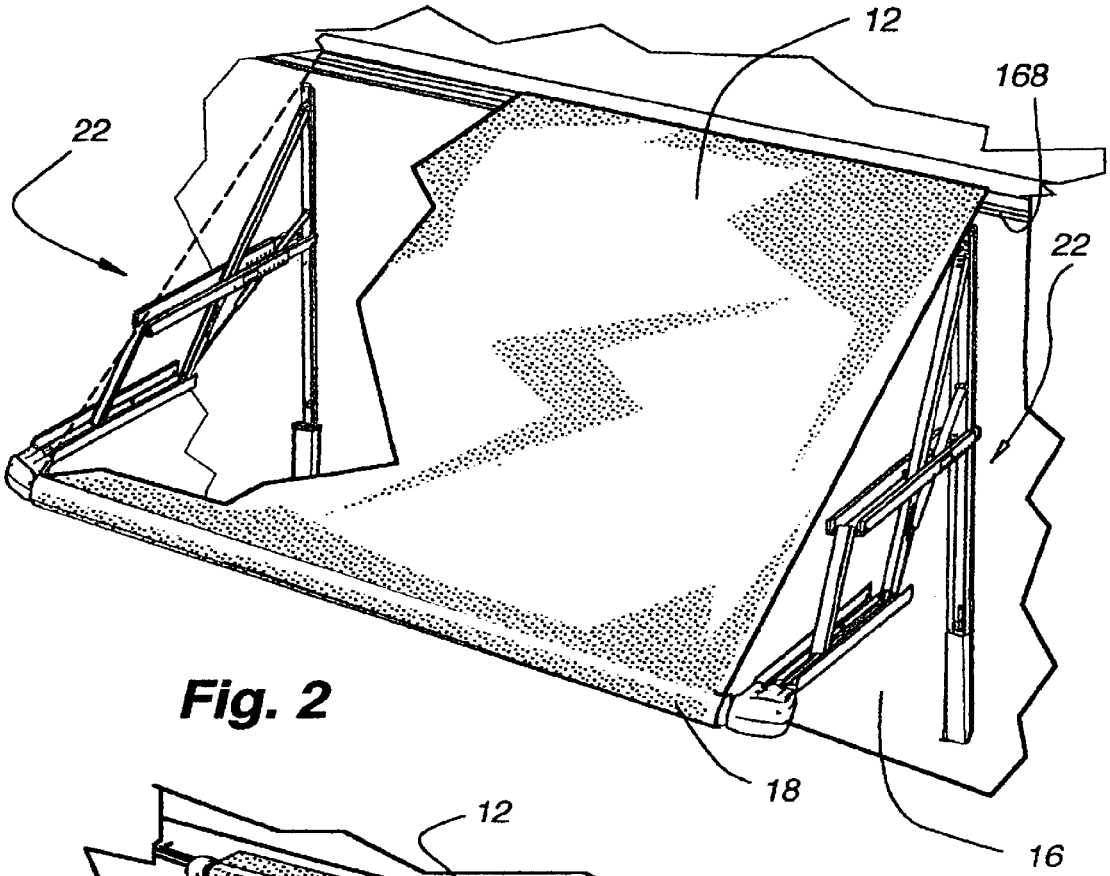
FIG. 2 is an isometric view of the awning in the extended position looking downwardly on the awning with parts removed for clarity.
Figure 3:
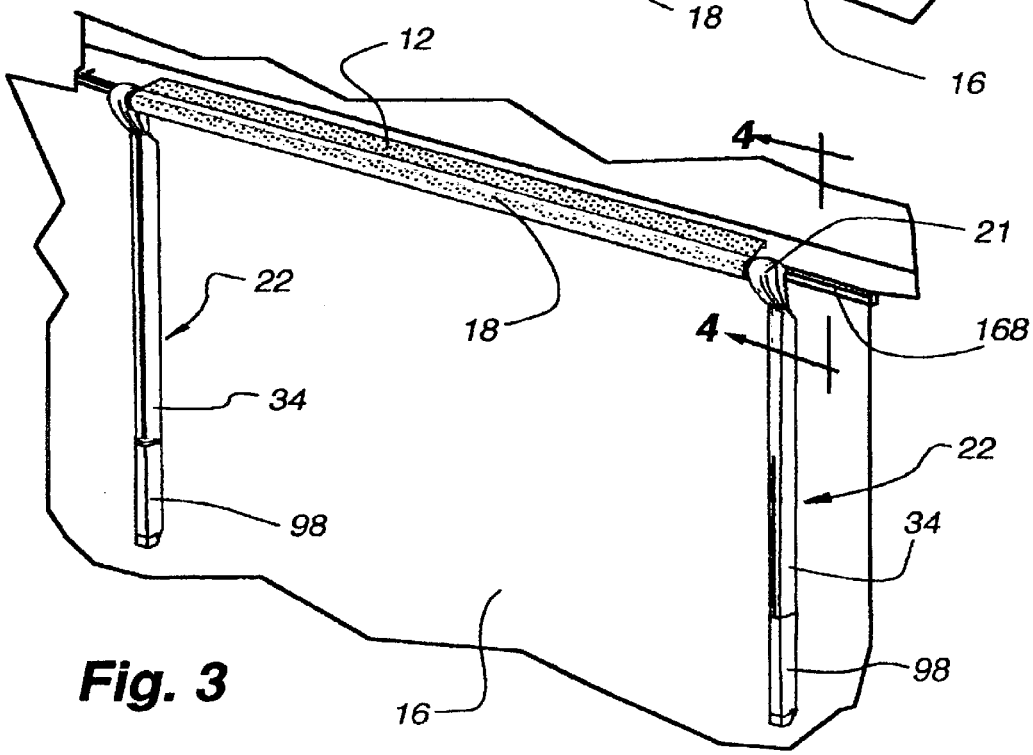
FIG. 3 is an isometric view similar to FIG. 2 with the awning in a fully retracted position.
Figure 6:
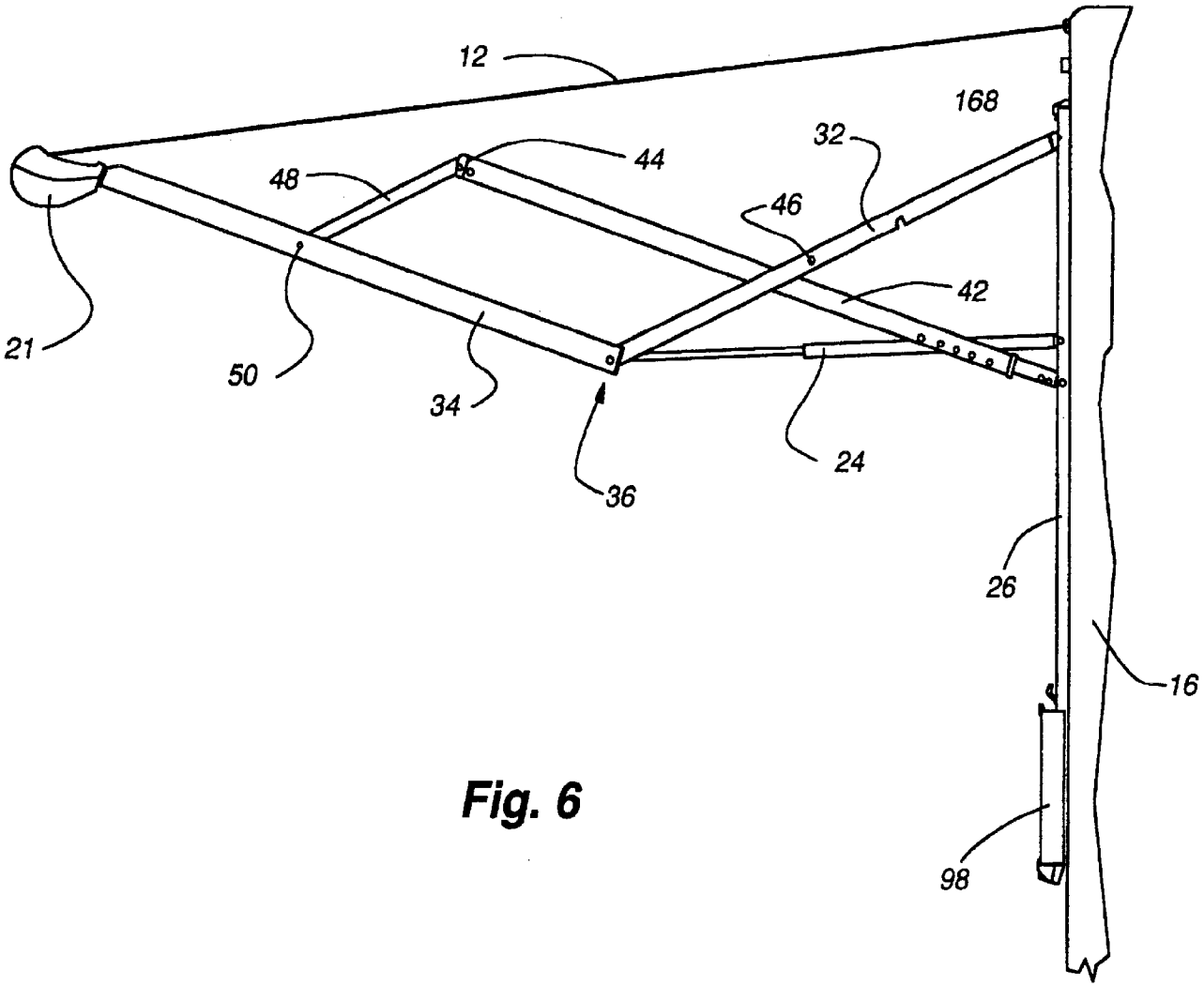
FIG. 6 is a side elevation of the awning of the invention in a fully extended position.
Figure 9:
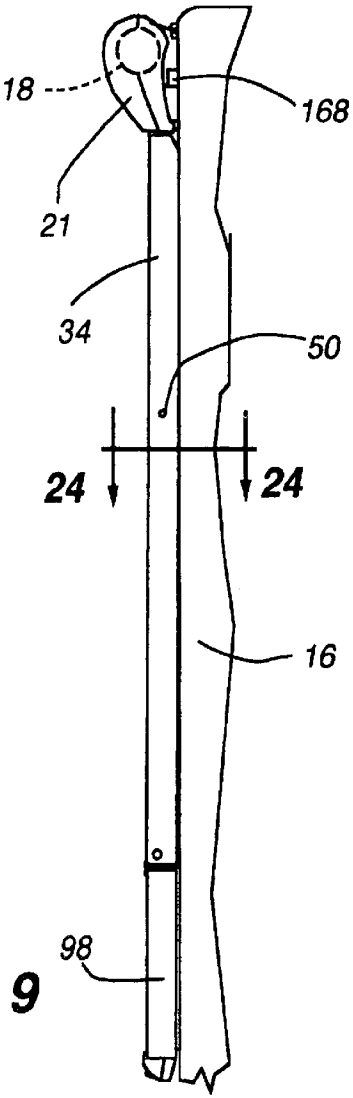
FIG. 9 is a side elevation of the awning in a fully retracted position.
Figure 15:
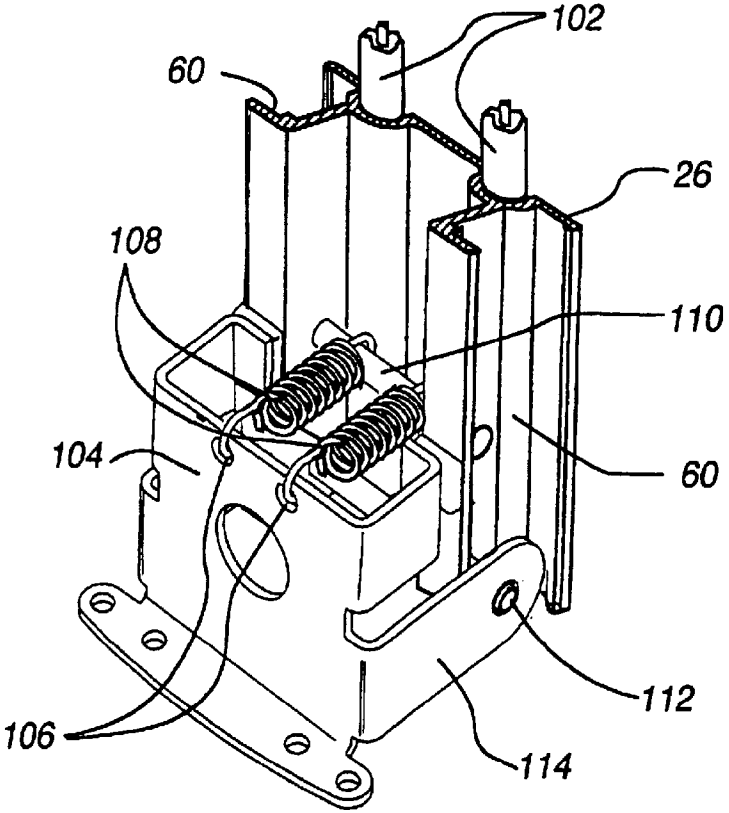
FIG. 15 is an isometric of part of the housing of FIG. 14 and mounted on a guide channel.
Figure 14:
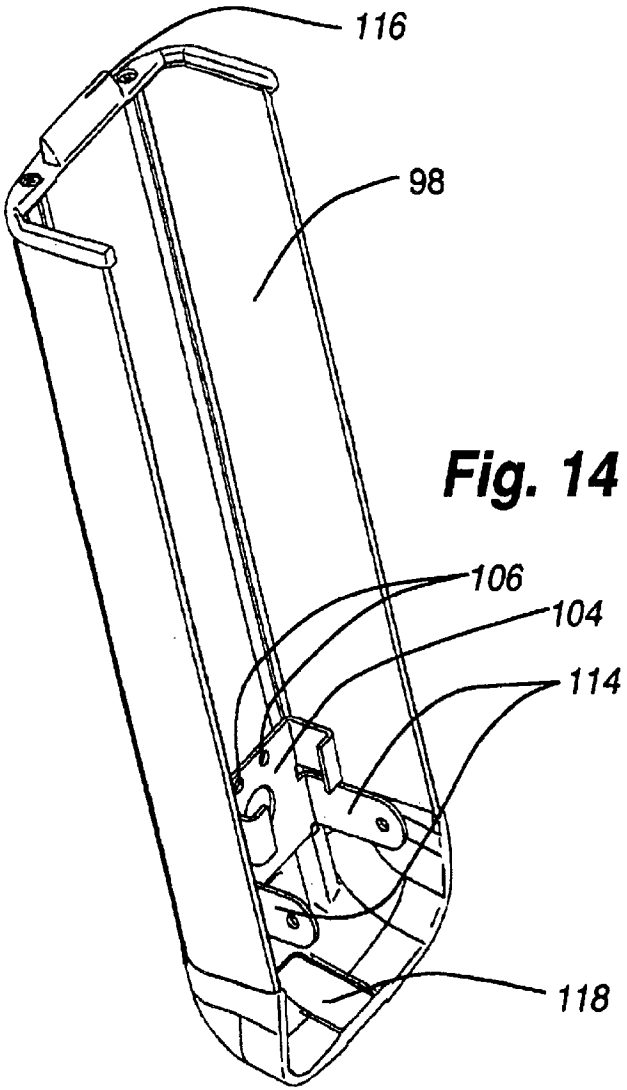
FIG. 14 is an isometric looking at the inside of the pivotal housing incorporated into each support structure.

The rollers 43 on the inner ends of the extendible brace arms 42 ride in outwardly directed grooves 60 (FIG. 15) provided in the guide channels 26 so that the inner ends of the extendible brace arms can roll vertically and reciprocally along the length of the guide channels as the support structure is moved between the extended position of FIGS. 1, 2, and 6 and the fully retracted position of FIGS. 3 and 9. As will be appreciated, when the awning is retracting, the inner ends of the extendible brace arms roll downwardly in the guide channels and when the support structure is extending, the inner ends of the extendible brace arms roll upwardly in the guide channels. It will be apparent that the pair of guide channels 26 could be replaced with a single guide channel (not shown) that has outwardly directed grooves along opposite sides that would receive the rollers 43 on the inner ends of the extendible brace arms. Of course the gas spring 24 would then be anchored to the single guide channel.

Figure 7:
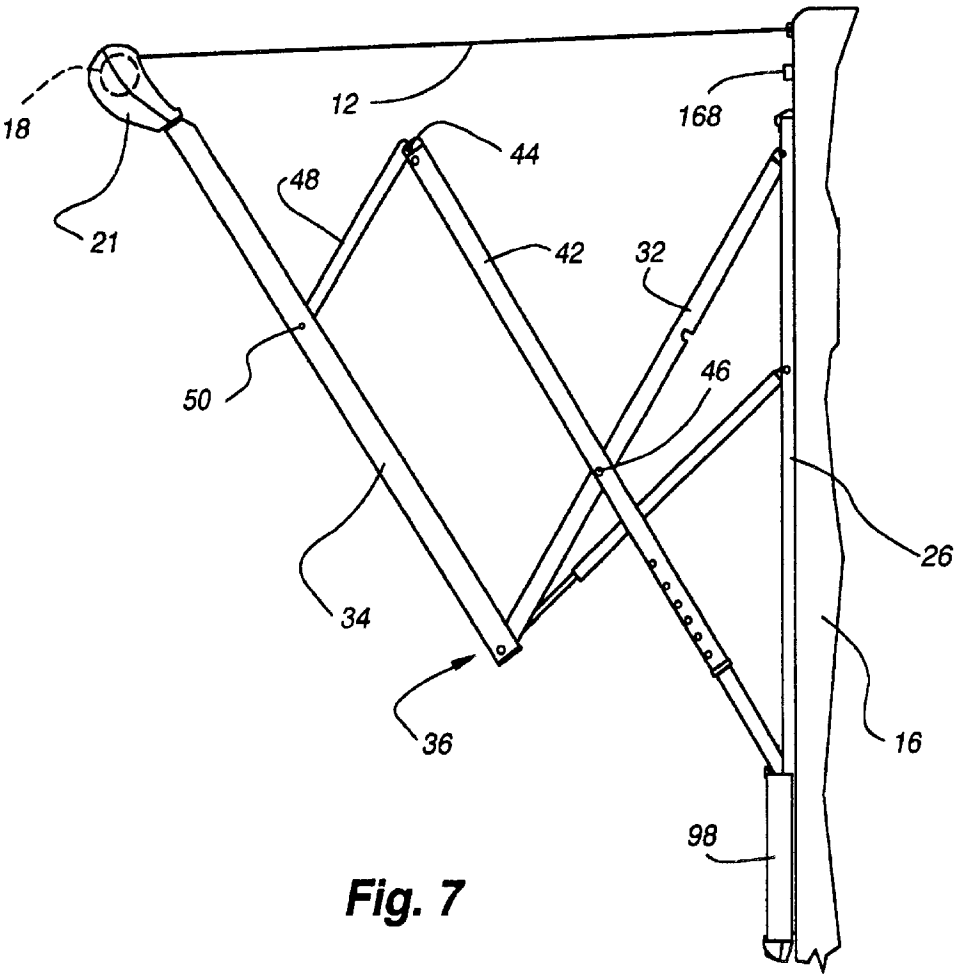
FIG. 7 is a side elevation of the awning of the invention in a partially retracted position.
Figure 8:
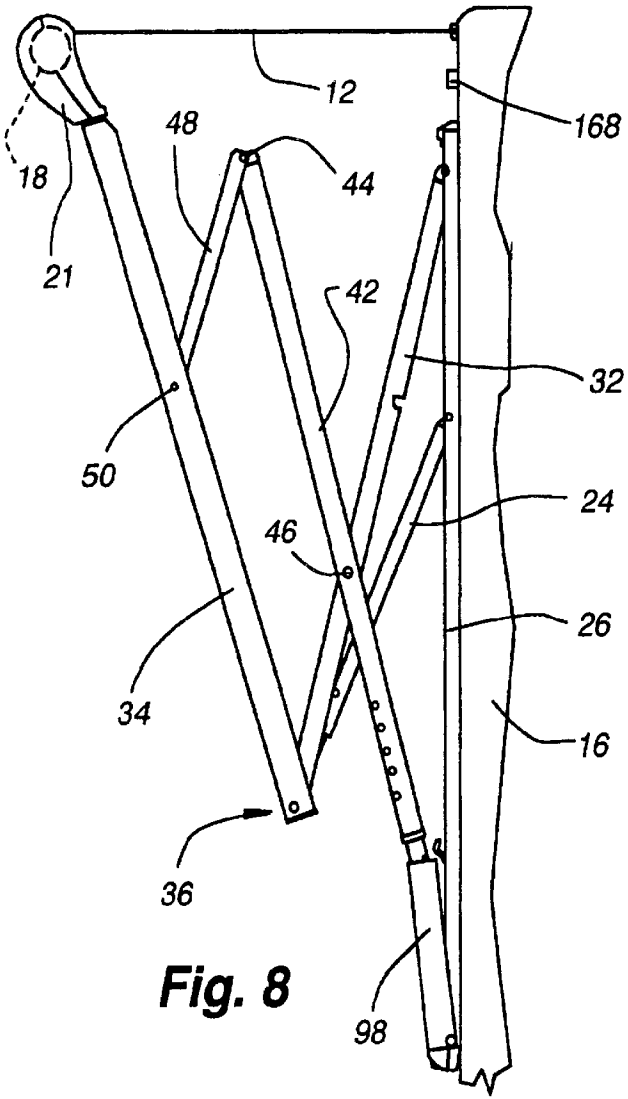
FIG. 8 is a side elevation of the awning of the invention in a substantially retracted position.

In operation of the awning 10, commencing from the fully retracted position of FIGS. 3 and 9, the motor 20 is energized to rotate the roll bar 18 in a direction allowing the awning sheet 12 to unwrap from the roll bar with the initial movement being shown in FIG. 8. When operating the awning, the clamp 56 on the extendible brace arms 42 may be released so that the length of the brace arms can fluctuate during movement of the awning. The clamp does not need to be released, however, as the awning will operate fully no matter what the fixed or variable length of the extendible brace arms might be. With the extendible brace arms at their maximum length, the awning will continue to extend from the position of FIG. 8 through the position of FIG. 7 and ultimately to the position of FIG. 6 where the awning sheet is slightly inclined downwardly from its inner edge to the roll bar.

Figure 26:
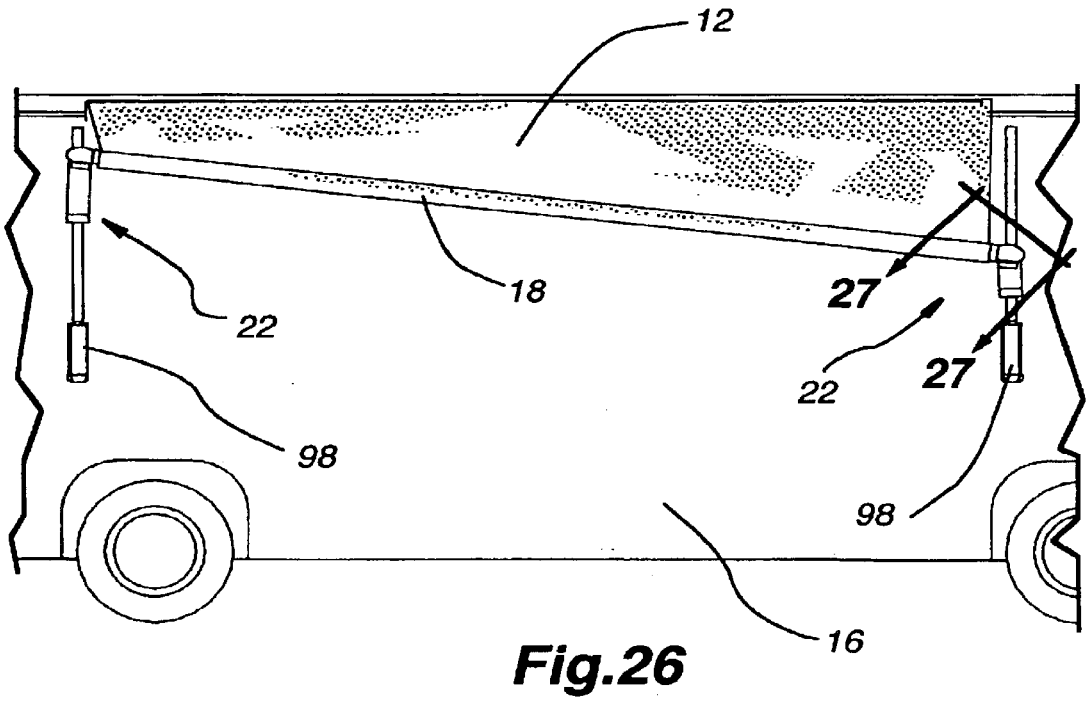
FIG. 26 is a side elevation similar to FIG. 25 with one end of the awning having been lowered.
Figure 28:
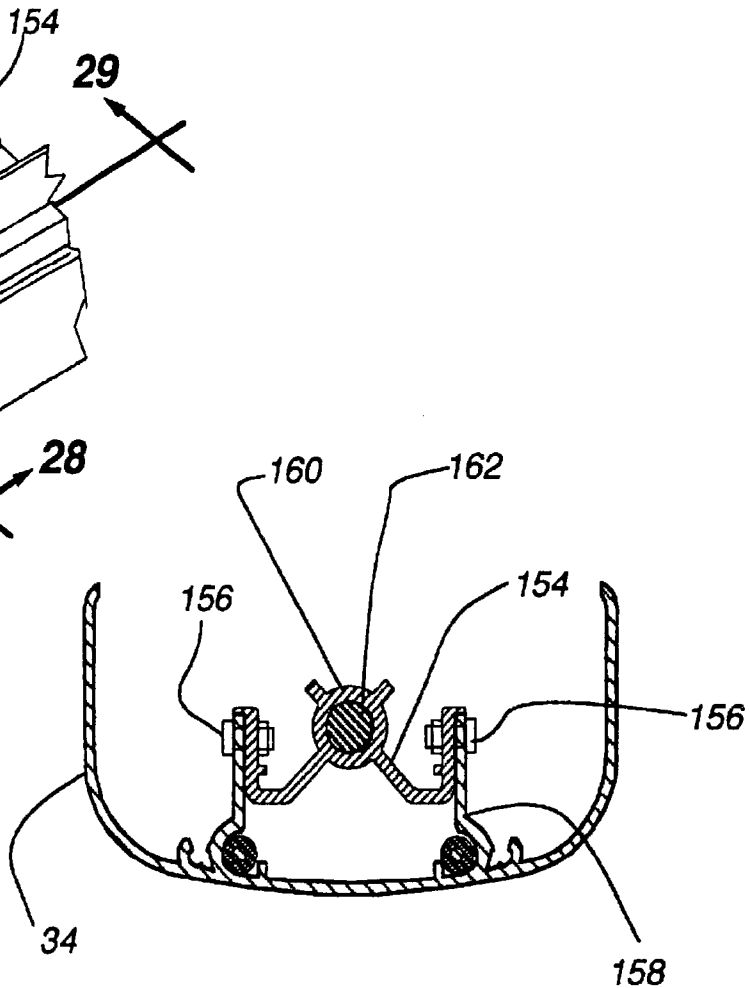
FIG. 28 is an enlarged section taken along line 28—28 of FIG. 27.

With the awning in the extended position of FIG. 6, the extendible brace arms 42 can be shortened by adjusting the clamps which force the roll bar to drop establishing a greater decline or pitch of the awning sheet from the support surface. Further, only one extendable brace arm can be shortened so that the awning sheet will tilt to one side (FIG. 26) to encourage drainage of water from the awning sheet. Also, the roll bar can be yieldingly pulled down against the bias of the gas spring if desired to encourage drainage from the awning sheet.

If the awning is retracted from the extended position of FIG. 6, the roll bar 18 is caused to initially move upwardly as it is being moved toward the support surface 16 into, for example, a partially extended position shown in FIG. 7. This again may be desirable depending upon climate conditions, the angle of the sun or the like. The awning can of course be fully retracted even when the brace arms are maximally extended.

It is important to note that when the awning is fully extended as in FIG. 6, regardless of the length of the brace arms 42, there is reasonable clearance along each lateral side of the awning so that individuals are free to move under and away from the awning without interference from a support arm of the type that is traditionally found in such awnings that extends downwardly from the roll bar to a relatively low location on the support surface 16. Further, it will be appreciated that the awning will remain extended unless a predetermined amount of weight is placed on the awning such as by a quantity of rainwater accumulating on the awning sheet 12 in which circumstance, the gas springs are allowed to give enough to allow the water to be automatically discharged or drained from the awning sheet.

The pitch or angle of the awning sheet 12 from the support surface to the roll bar can be easily adjusted and with the embodiment illustrated, that angle can vary between zero and 25 degrees from horizontal. Further, the pitch of the awning sheet is easily adjusted by releasing the clamps 56 on the extendible brace arms 42 and lifting or lowering the roll bar 18. It is easy to lift the roll bar as the lift is assisted by the gas spring 24. Further, there are no support arms extending from the roll bar to a relatively low location on the support surface so that people can freely walk under the support structures and do not need to walk around support arms as has been the case with most conventional retractable awnings.

As mentioned previously, the awning can be opened and closed with any set or variable length of the extendible brace arms. If the brace arms are in a maximally extended position, the angle or pitch of the awning canopy when the awning is fully extended is close to zero degrees from horizontal. If the extendible brace arms are shortened to their minimal length, the awning will automatically extend or deploy so that the awning sheet is at an angle of 25 degrees relative to horizontal even though the awning canopy quickly achieves an angle of substantially 0° if retracted a couple of feet from its furthest extended position. It is also important to note that when the awning is operated with the extendible brace arms in their minimum length, the roll bar when retracting from its fully extended position initially moves abruptly upwardly before moving toward the support surface as shown in phantom lines in FIG. 7, so that if the awning was mounted over a slide out unit of a recreational vehicle, for example, or over a door in the support surface, the awning will clear either the slide out unit or the door and further allows either to operate while the awning is extended.

The parallelogram linkage 58 in the support structures 22 provides considerable stability for the awning so that it is safe in windy conditions and can operate in windy conditions which is many times desirable as awnings are not always operated in fair weather conditions. Further, as noted previously, the awning will automatically partially collapse upon receiving a predetermined amount of weight so as to dump water that might otherwise collect on the awning sheet.

Figure 16:
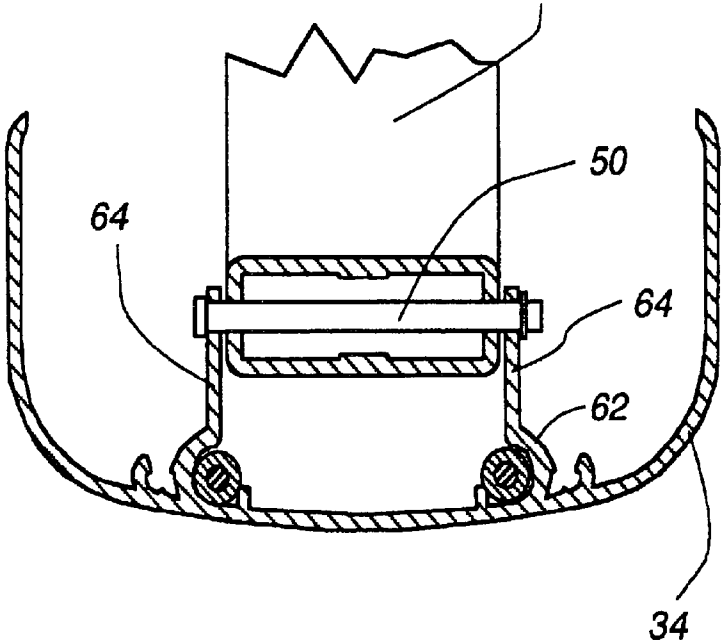
FIG. 16 is an enlarged fragmentary section taken along line 16—16 of FIG. 5.

With more specificity as to the component parts of each support structure, reference is first made to FIG. 16 which illustrates the intermediate location on the fixed length outer brace arm 34 where it is connected to the outer end of the auxiliary brace arm 48 by the pivot pin 50. It will be seen that the fixed length outer brace arm is of U-shaped channel construction opening upwardly when the awning is extended. A bracket 62 is fixedly mounted in the fixed length outer brace arm at the intermediate location with the bracket having upstanding ears 64 which pivotally support the pivot pin 50.

Figure 17:
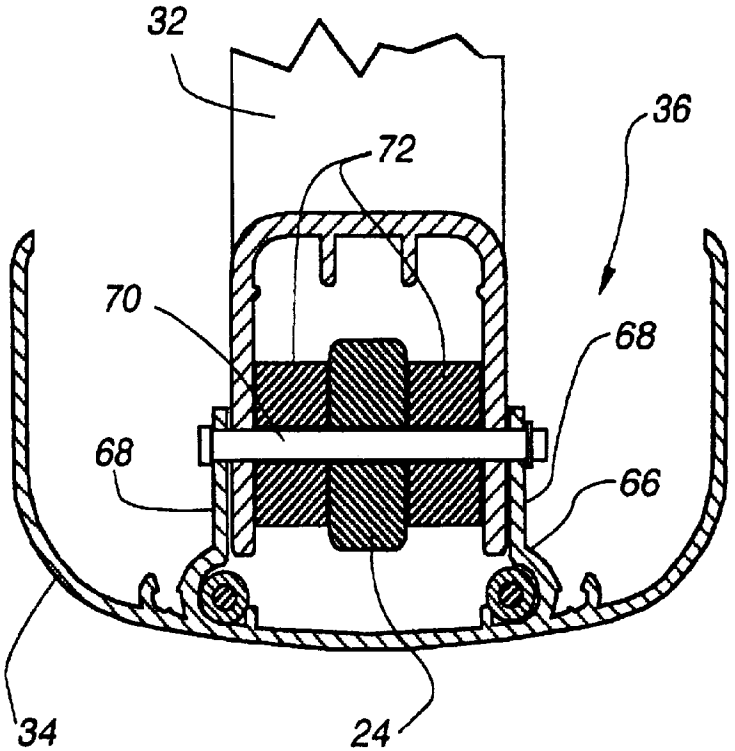
FIG. 17 is an enlarged fragmentary section taken along line 17—17 of FIG. 5.

Referencing FIG. 17, the elbow joint 36 can be seen to include another fixed bracket 66 in the fixed length outer brace arm 34 having upstanding ears 68 that pivotally support a pivot pin 70 with the pivot pin in turn pivotally supporting the outer end of the fixed length inner brace arm 32. The pivot pin 70 further supports a pair of spacers 72 that confine therebetween the outer end of the associated gas spring 24.

Figure 18:
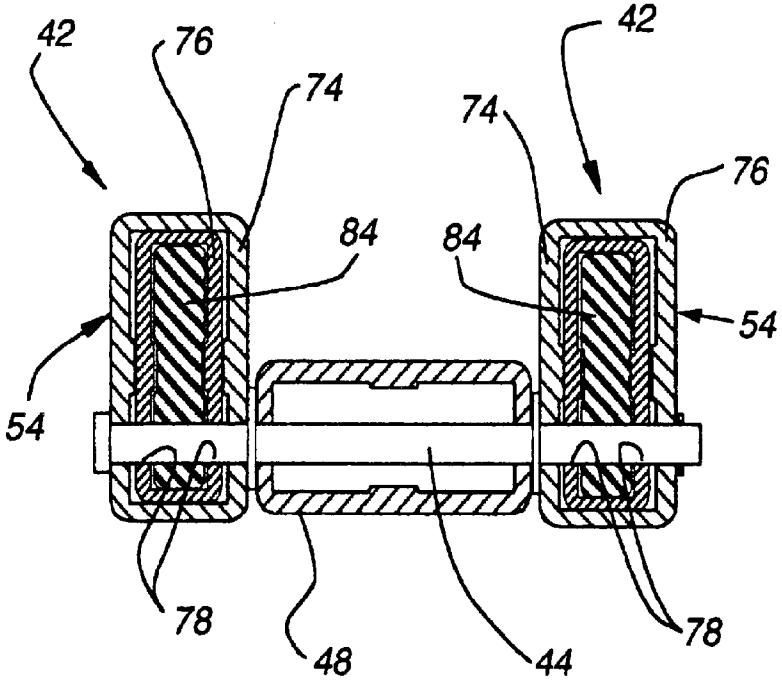
FIG. 18 is an enlarged fragmentary section taken along line 18—18 of FIG. 5.
Figure 22:
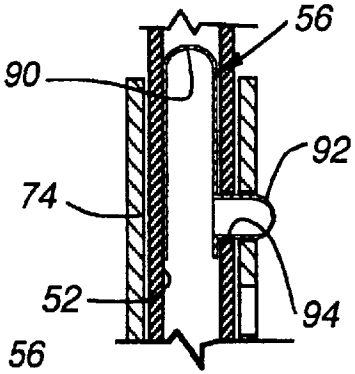
FIG. 22 is a fragmentary section taken along line 22—22 of FIG. 20.

The connection of the inner end of the auxiliary brace arm 48 with the outer ends of the extendable brace arms 42 is shown in FIG. 18 where it will be seen that the inner end of the tubular auxiliary brace arm 48 supports the pivot pin 44 that protrudes laterally from opposite sides thereof to support each of the extendable brace arms that are mounted as a pair in the support structure. Each extendable brace arm as mentioned previously has inner 52 and outer 54 telescoping component parts. The outer component part 54 includes a tubular member 74 of rectangular transverse cross-section and adjacent to its outer end and disposed internally thereof a rectangular reinforcement tube 76 of slightly smaller cross-sectional size. The reinforcement tube extends from the outer end of each extendable brace arm inwardly through the intermediate location of the pivot pin 46 where the pivot pin 46 supports the fixed length inner brace arm 32. The inner reinforcement tube 76 has aligned pairs of transverse openings 78 and 80 (FIGS. 18 and 19) therethrough for respectively receiving at their outer ends the pivot pin 44 and near their inner ends for receiving the pivot pin 46. Further, at the outer ends of each extendable brace arm, there is an end cap 82 of hard rubber or the like having a rectangular insert 84 received within the associated reinforcement member.

Figure 19:
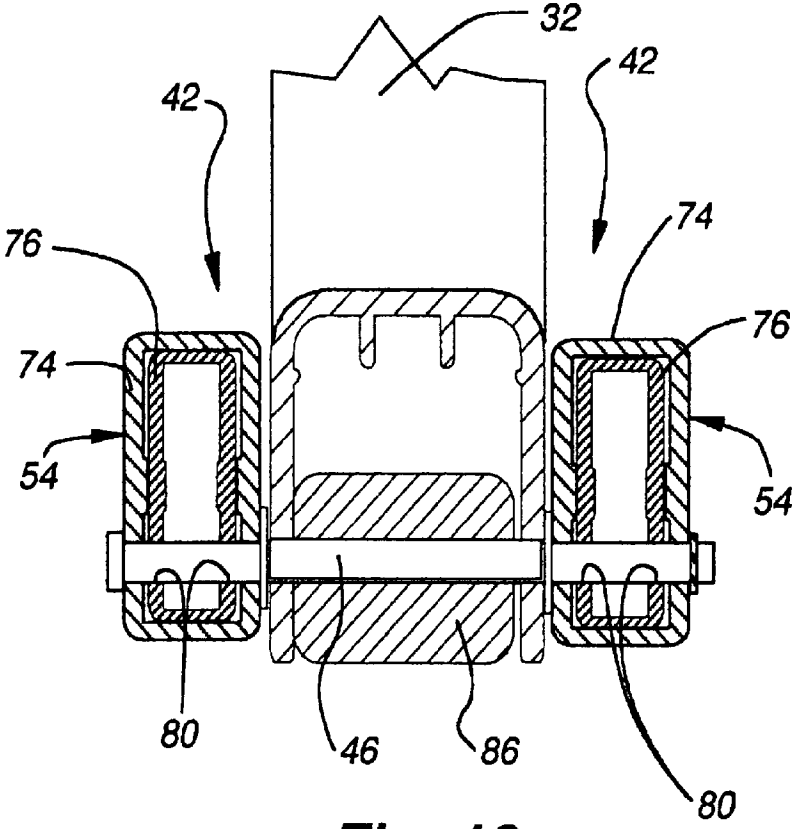
FIG. 19 is an enlarged fragmentary section taken along line 19—19 of FIG. 5.

FIG. 19 illustrates the intermediate location along the length of the extendable length brace arms 42 where the pivot pin 46 can be seen to extend through a reinforcement grommet 86, the tubular fixed length inner brace arm 32 and through each of the extendable brace arms. As mentioned previously, each extendable brace arm has inner 52 and outer 54 component parts with the outer component part having been previously described as including a tubular member 74 of rectangular transverse cross-section and having a reinforcement tube 76 along an outermost portion of its length. Along an innermost portion of its length, the outer component part 54 telescopically and slidably receives the inner component part 52 with the clamp 56 being adapted to selectively lock the inner and outer components of each extendable brace arm at longitudinally selected positions.

Figure 23:
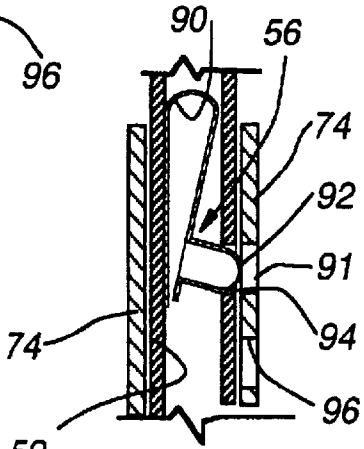
FIG. 23 is a fragmentary section taken along line 23—23 of FIG. 21.
Figure 21:
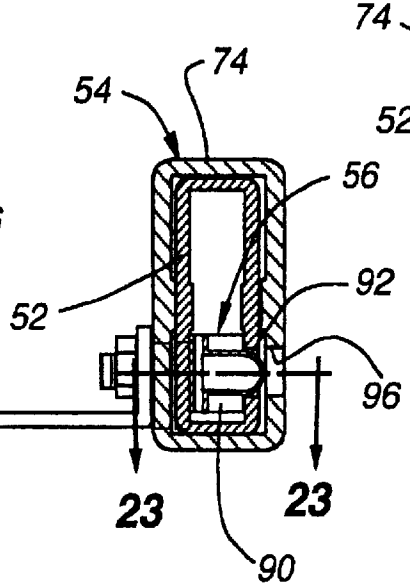
FIG. 21 is a section similar to FIG. 20 with the detents for locking the telescoping arms in a depressed position.
Figure 21:
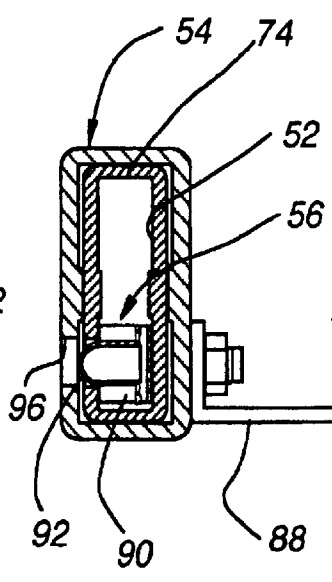
Figure 20:
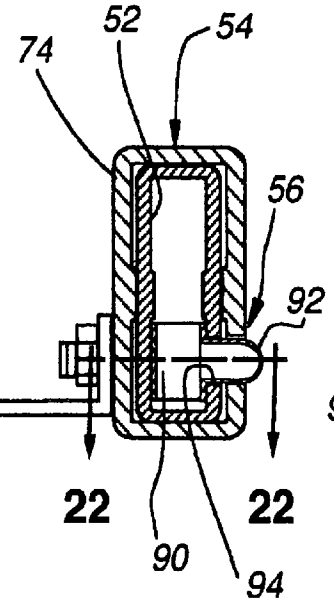
FIG. 20 is an enlarged fragmentary section taken along line 20—20 of FIG. 5.
Figure 20:
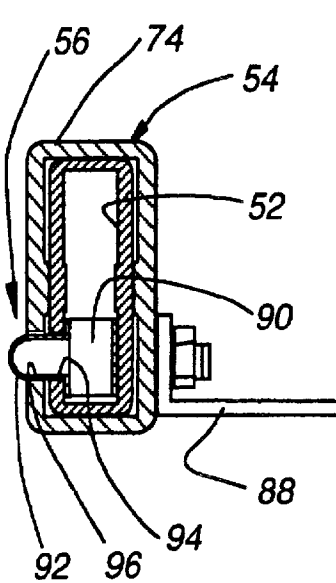

The clamp 56 is probably best illustrated in FIGS. 20–23 to be approximately positioned at a longitudinal location along the length of the outer component part 54 of the extendable brace arms that is aligned with a U-shaped spacer bracket 88 connected to the outer component parts of the adjacent extendable length brace arms 42. Each clamp includes a spring-biased detent 90 fixedly mounted within the inner component 52. Each detent is in the form of a leaf spring having a rounded bulbous head 92 on a free end thereof which protrudes into and selectively through an opening 94 in the side wall of the inner component 52. The rectangular tube 74 of the outer component 54 of each extendable arm has a plurality of longitudinally spaced openings 96 adapted to be selectively aligned with the opening 94 in the inner component so that when an opening in the outer component 54 is aligned with the opening in the inner component, the bulbous head 92 on the detent will protrude through both openings to lock the inner and outer components of the associated extendable brace arm in a fixed longitudinal relationship. Of course, the bulbous head of the detent can be manually depressed enough to allow the outer component 54 to slide relative to the inner component 52 as seen in FIGS. 21 and 23 until the opening 94 in the inner component is aligned with another selected opening 96 in the outer component. As will be appreciated by reference to FIGS. 20–23, there is a detent in each extendable brace arm so that both detents in an associated pair of brace arms must be depressed simultaneously to extend or retract the length of the associated pair of brace arms.

Figure 24:
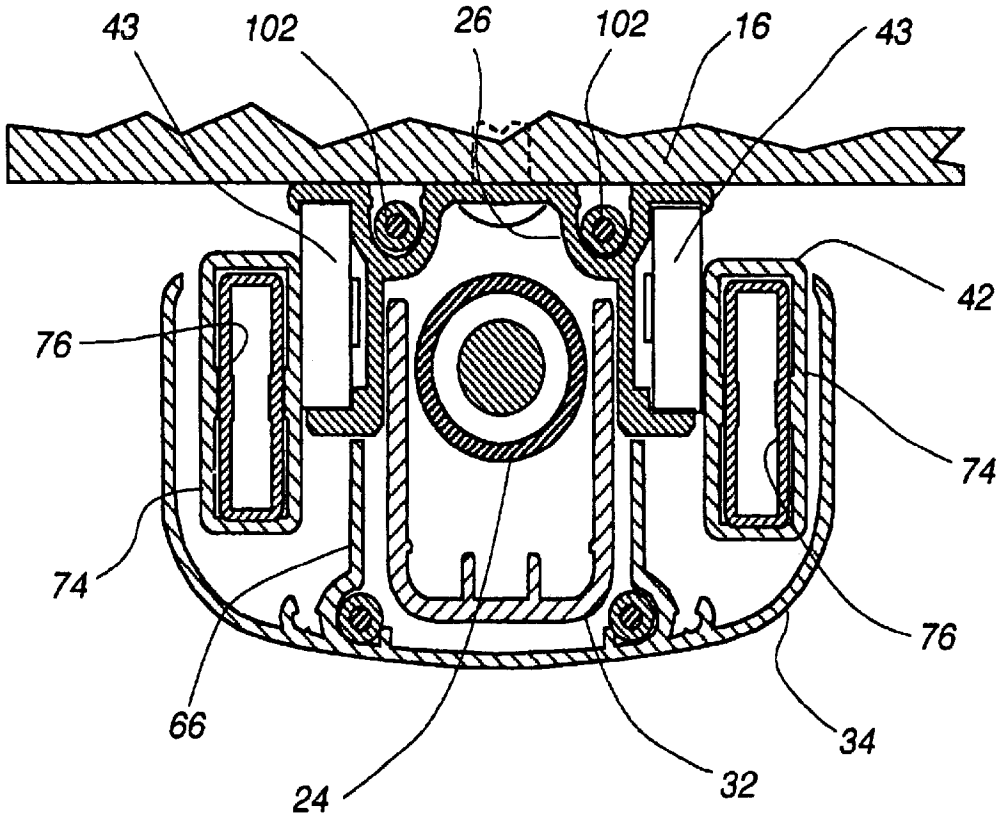
FIG. 24 is an enlarged fragmentary section taken along line 24—24 of FIG. 9.
Figure 25:
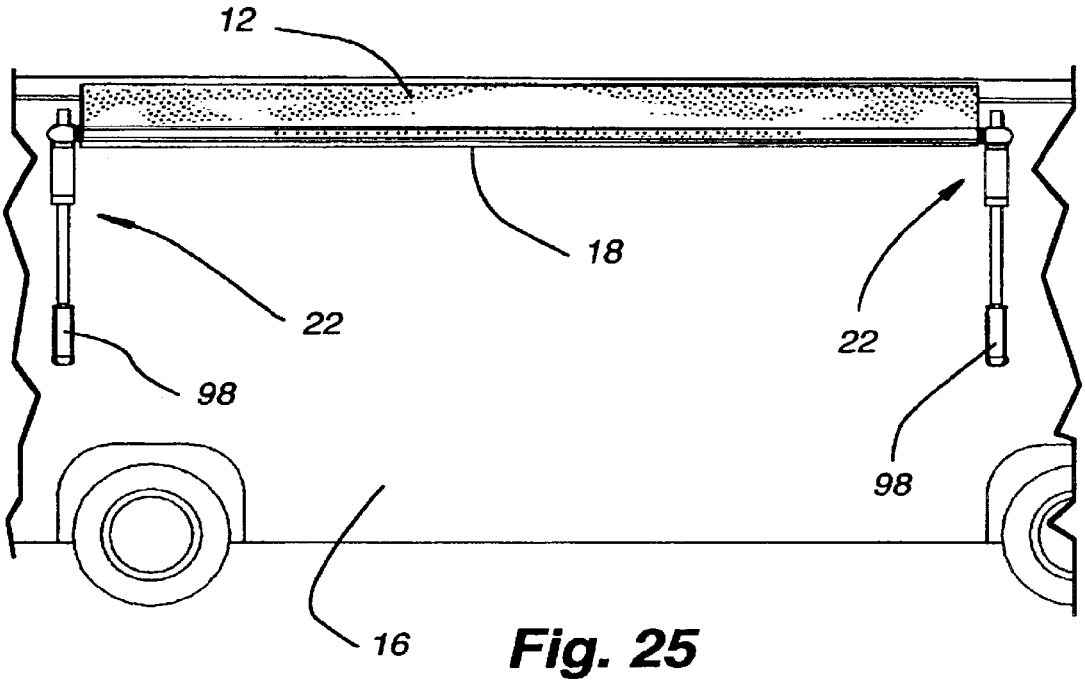
FIG. 25 is a fragmentary side elevation of the awning of the present invention in a fully extended position mounted on the side of a recreational vehicle.

Referencing FIG. 24, the various components of a support structure 22 can be seen neatly confined within the fixed length outer brace arm 34 when the awning is in the retracted position of FIG. 9. As will be appreciated, the fixed length outer brace arm in effect forms a cover around the pair of extendable length brace arms 42, the fixed length inner brace arm 32, the auxiliary brace arm 48 and the gas spring 24 so they are effectively hidden from view.

Figure 10:
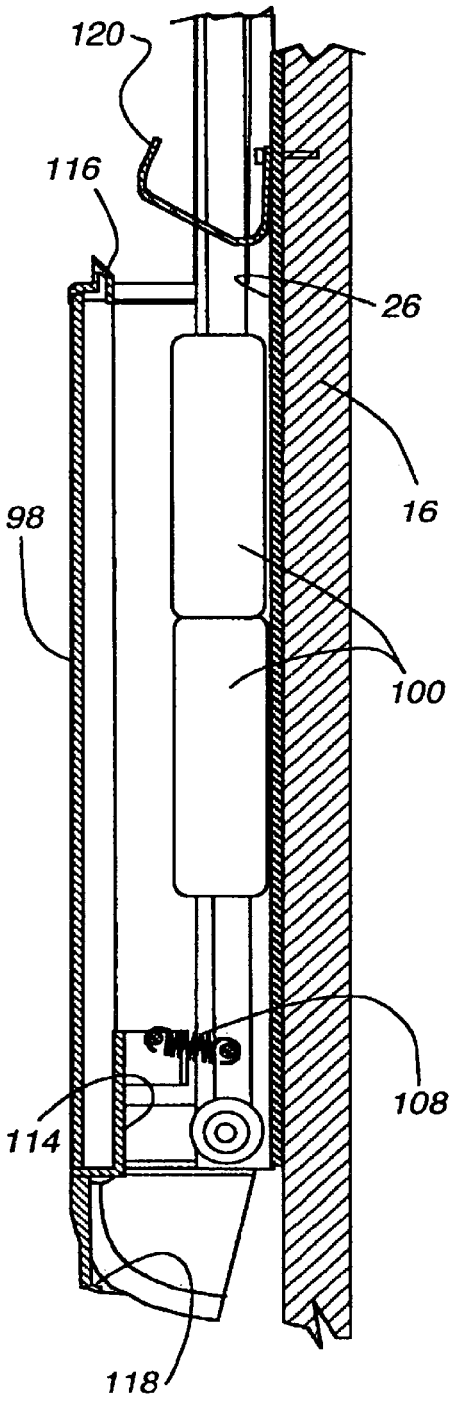
FIG. 10 is an enlarged fragmentary section taken along line 10—10 of FIG. 5.
Figure 11:
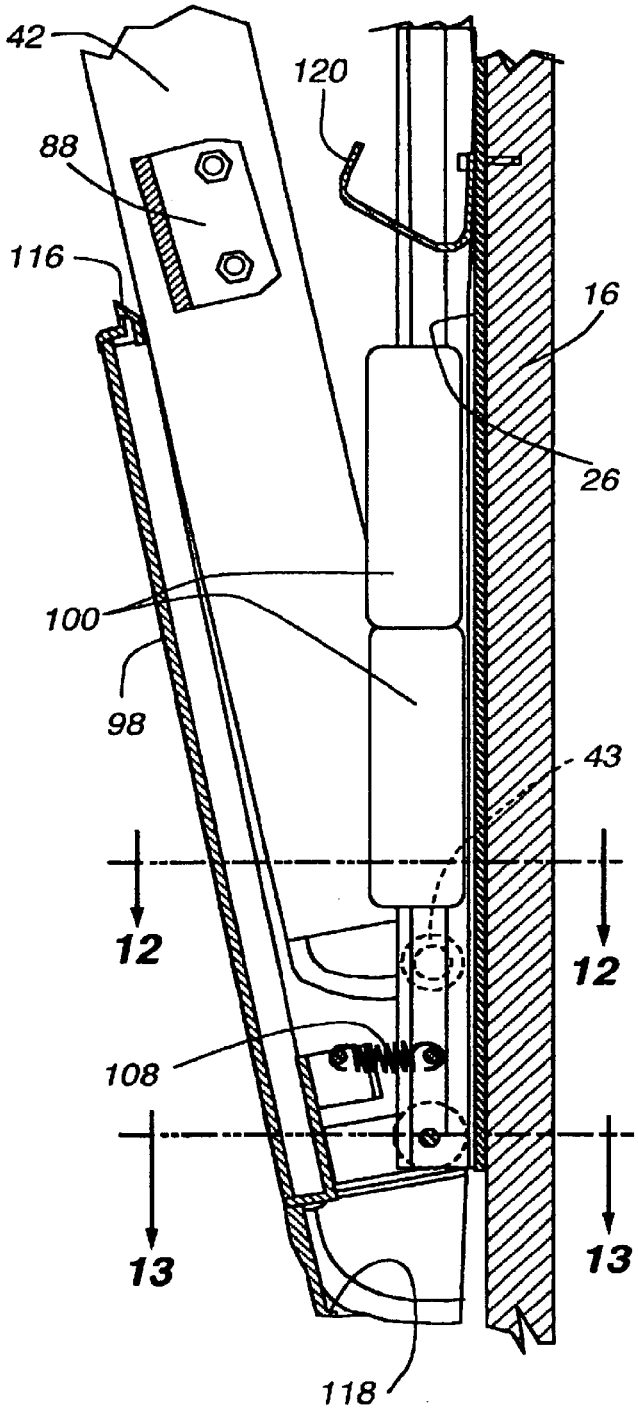
FIG. 11 is a fragmentary section similar to FIG. 10 with the awning in a substantially retracted position.
Figure 13:
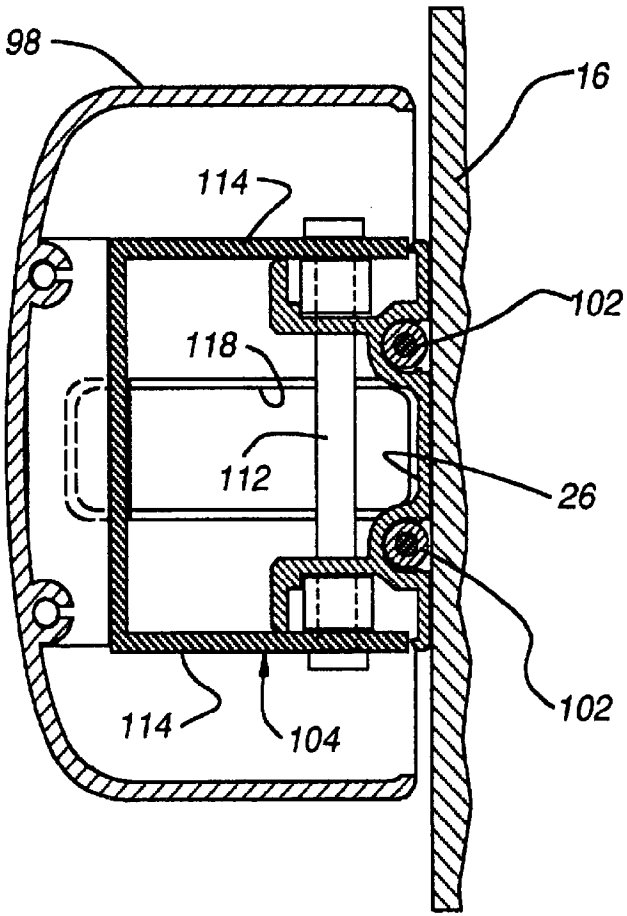
FIG. 13 is an enlarged fragmentary section taken along line 13—13 of FIG. 11.
Figure 12:
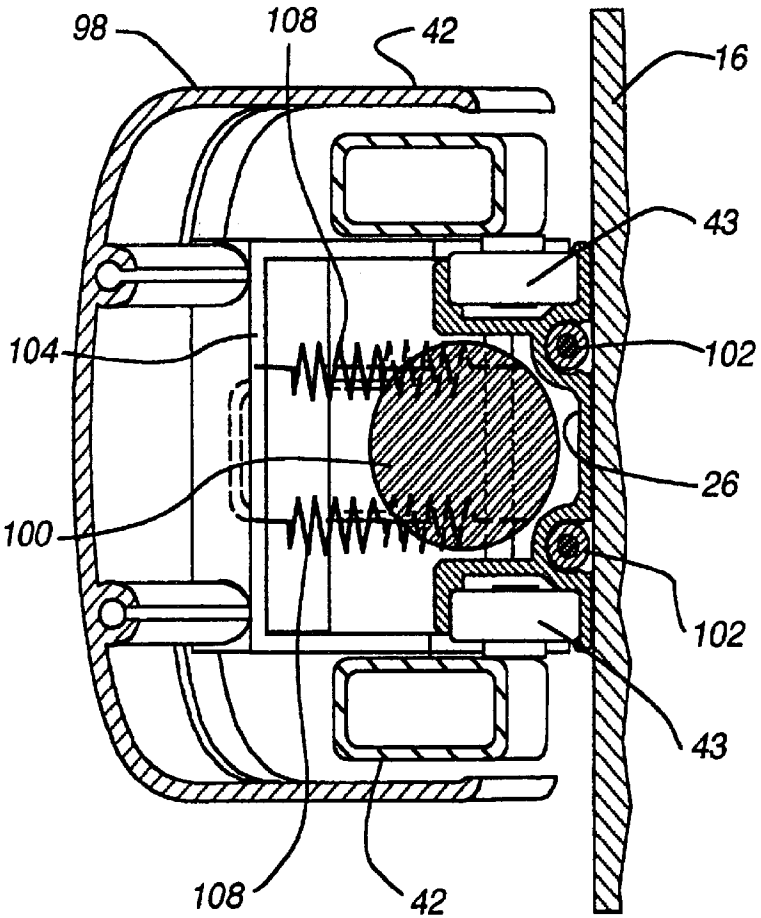
FIG. 12 is an enlarged fragmentary section taken along line 12—12 of FIG. 11.

As is probably best appreciated by reference to FIGS. 3 and 9, when the awning is fully retracted, the vertically oriented fixed length outer brace arm 34 does not extend the full height of the spaced guide channels 26 but rather is spaced upwardly from the lower end of the spaced guide channels. At the lower end of the spaced guide channels, an auxiliary housing 98 is pivotally mounted to conceal the components of the associated support structure that extend beyond the lower end of the fixed length outer brace arm 34 and also serves to conceal a pair of batteries 100 for operating the awning if batteries are the selected energy source. The batteries, as seen in FIGS. 10 and 11, are mounted within the space between the guide channels 26 and secured therein in any suitable manner. Electrical wiring 102 for connection to the batteries can be seen in FIG. 15, for example, and can extend up the rear side of the guide channels and subsequently downwardly through the inner fixed length brace arm 32, through the fixed length outer brace arm 34, to the motor 20 which is mounted, as mentioned previously, in the gear housing 21 at one end of the roll bar.

With reference to FIGS. 10–15, the auxiliary housing 98 can be seen to have a bracket 104 fixedly mounted therein adjacent to the bottom end of the auxiliary housing with the bracket including a pair of apertures 106 for mounting one end of a pair of coil springs 108, the other ends of which are attached to an anchor pin 110 secured to the spaced guide channels 26. The bracket 104 is pivotally connected to the spaced guide channels 26 by a pivot pin 112 passing through a pair of ears 114 on the bracket adjacent to its lower edge and as will be appreciated, the bracket is allowed to pivot against the bias of the coil springs but the coil springs will return the bracket to its upright position of FIG. 15 as a neutral position.

The bracket 104, as mentioned previously, is secured to the auxiliary housing 98 so that the auxiliary housing moves in unison with the bracket. The housing is mounted for pivotal movement to provide space for the lowermost components of each support structure 22 to move into and out of the housing. As can be seen, the lower or innermost ends of the extendable brace arms 42 are received within the auxiliary housing when the awning is fully retracted but as the innermost ends of the extendable brace arms begin upward movement, the extendable brace arms pivot outwardly and in doing so force the auxiliary housing to pivot about the pivot pin 112 against the bias of the coil springs 108 until the lower end of the extendable brace arms pass beyond the upper edge of the auxiliary housing at which time the auxiliary housing pivots from its open position of FIG. 11 to its closed position of FIG. 10. The auxiliary housing has a cam surface 116 along its upper edge which is adapted to engage the associated extendable brace arms when the awning is moved from the position of FIG. 7 to the position of FIG. 8 and when that engagement takes place, the auxiliary housing is forced to pivot in a counterclockwise direction as viewed in FIGS. 10 and 11 against the bias of the coil springs to allow space for the extendable brace arms to slide downwardly into the auxiliary housing. Of course, when the extendable brace arms are fully received within the auxiliary housing, the coil springs cause the auxiliary housing to retract to the closed position of FIG. 10 and in vertical alignment with the fixed length outer brace arm 34 so the entire length of the spaced guide rails are confined within either the fixed length outer brace arm or the auxiliary housing. It should be noted also that the auxiliary housing has an opening 118 through its lower end to prevent rain water or the like from accumulating in the housing.

Immediately above each auxiliary housing 98, a leaf spring 120 is mounted between the guide rails 26. The leaf spring is adapted to abut the bracket 88 at the inner end of the pair of extendable length brace arms 42 so as to bias the associated support structure 22 away from the side 16 of the vehicle so that as the awning sheet is initially unrolled from the roll bar 18 the awning will be forced away from the support surface far enough to fall by gravity and under the influence of the gas spring 24 toward its extended position. The leaf spring also serves in the retracted position of the awning to bias the associated support structure away from the side of the vehicle while the motor 20 holds the awning against the side of the vehicle which prevents the awning from vibrating or rattling in the retracted position when the vehicle is moving.

As mentioned previously, there is a gear housing 21 positioned at each end of the roll bar 18 and at the outer end of each fixed length outer brace arm 34. The gear housing is probably best illustrated in FIGS. 27–30. As will be appreciated with the description that follows, one gear housing (the interior of which is not illustrated) simply serves in a conventional manner as a bearing for the associated end of the roll bar while the gear housing at the opposite end of the roll bar houses the motor 20 and other related components for reversibly rotatably driving the roll bar. Further, as will be appreciated with the description that follows, each gear housing is universally mounted to the outer end of its fixed length outer brace arm 34 so that one end of the awning can be lowered relative to the other in the manner previously described without putting a strain on the components of the awning.

Figure 29:
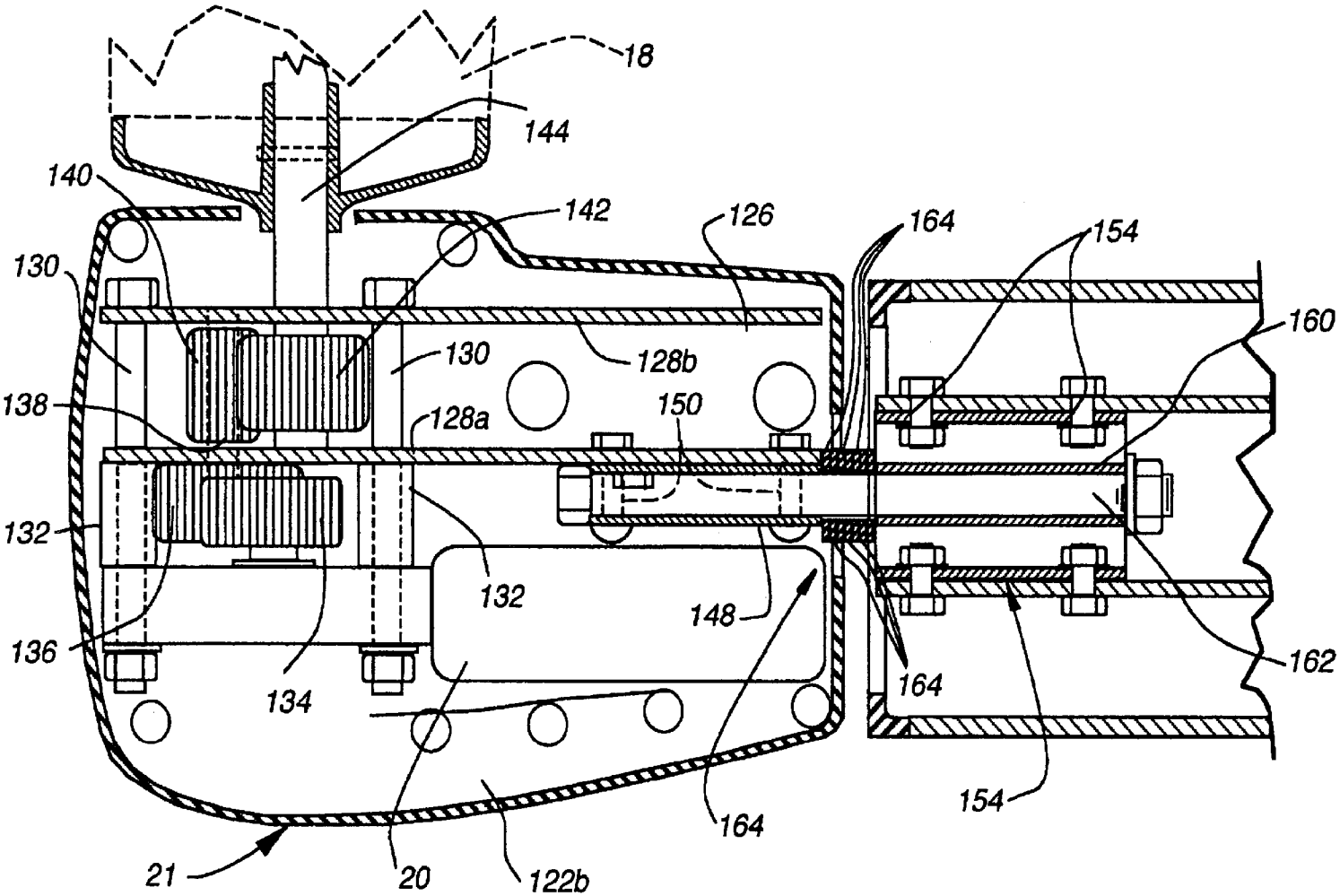
FIG. 29 is an enlarged fragmentary section taken along line 29—29 of FIG. 27.
Figure 30:
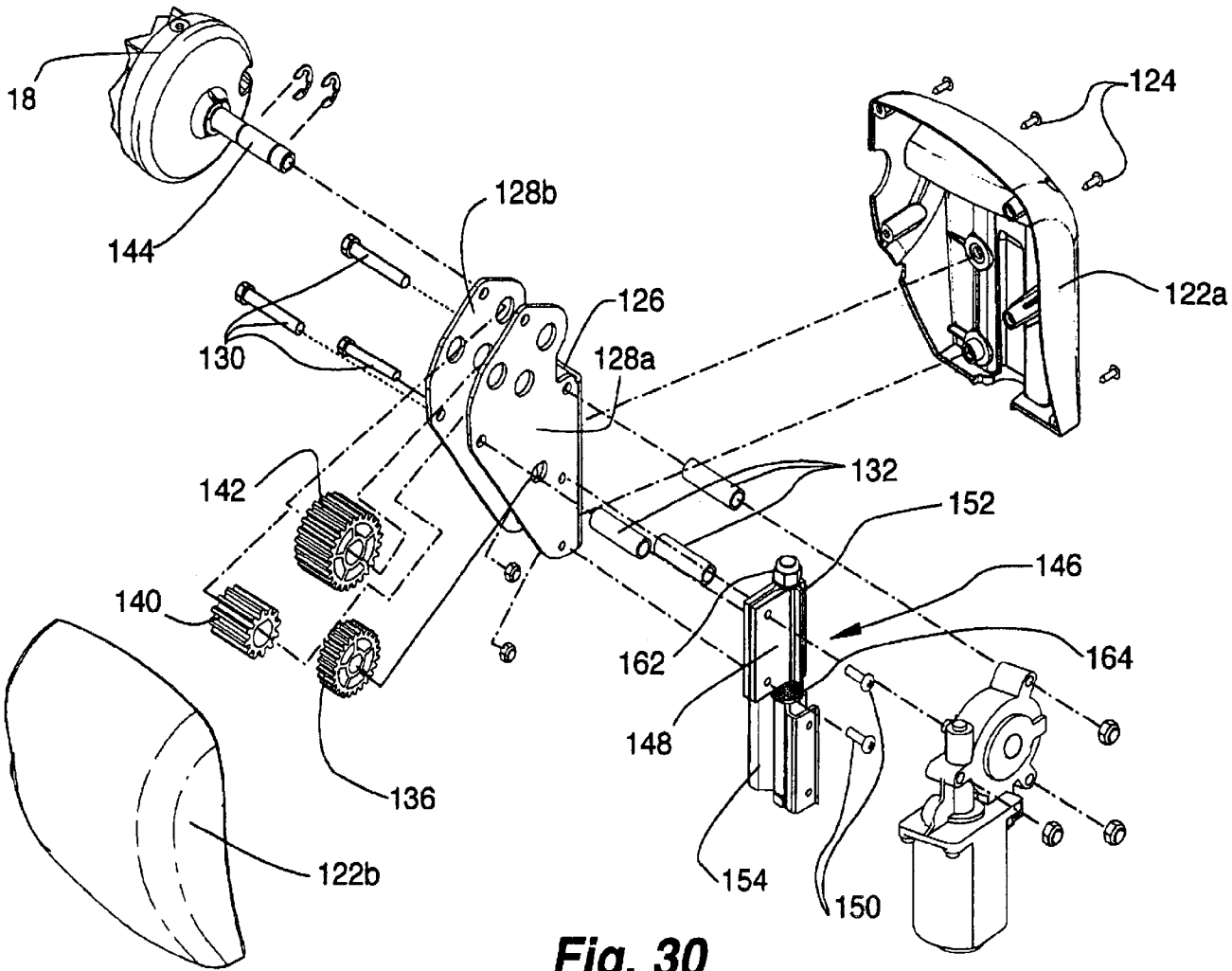
FIG. 30 is an exploded isometric showing the interconnection of one end of the awning roll bar to a support structure.

Looking more particularly at FIGS. 27–30, and particularly at FIG. 30, each gear housing 21 can be seen to include a pair of outer shroud components 122*a* and 122*b* for enclosing the working components. The outer shroud components can be secured together with fasteners 124. One shroud component 122*a* serves as a base on which a U-shaped bracket 126 having upstanding spaced parallel support plates 128*a* and 128*b* is mounted. The motor 20 is mounted on support plate 128*a* by a plurality of lag bolts 130 which extend through the support plates and cylindrical spacers 132 so the motor is mounted in spaced relationship from the adjacent support plate 128*a*. The motor has an output drive shaft extending perpendicularly to the plates and is keyed to a drive gear 134 positioned in the space between the motor and the adjacent support plate 128*a*. The drive gear 134 is meshed with a first transfer gear 136 mounted on a transverse axle 138 that also supports a second transfer gear 140 positioned between the support plates 128*a* and 128*b*. The second transfer gear 140 is meshed with a driven gear 142 also mounted between the support plates with the driven gear being connected to the drive shaft 144 at the associated end of the roll bar 18 for unitary rotation therewith. The drive shaft 144 rotates in unison with the remainder of the roll bar. The gear train is used to obtained the desired ratio between the speed of the output shaft of the motor and the rotational speed of the roll bar. The motor is of course reversible so that the roll bar can be selectively rotated in either desired direction.

Figure 27:
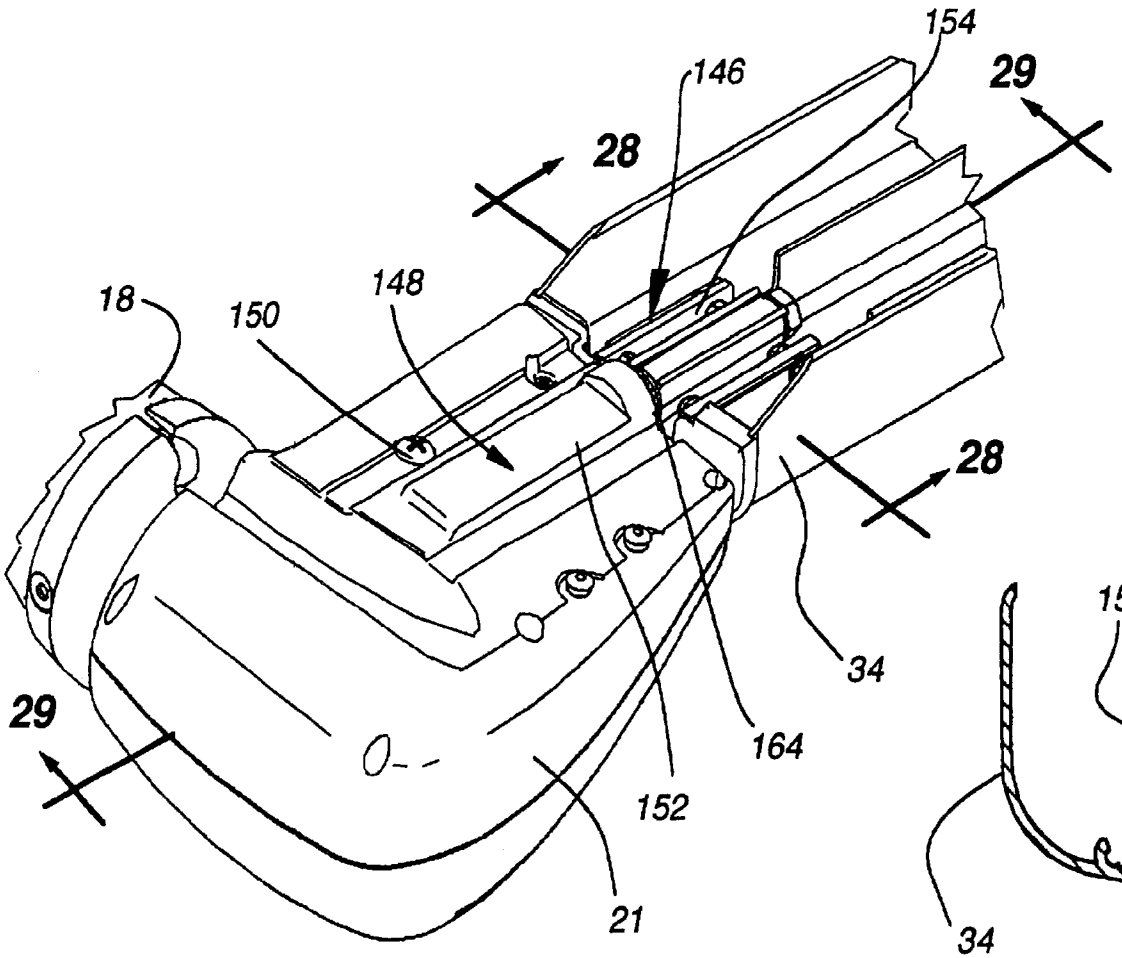
FIG. 27 is an enlarged fragmentary section taken along line 27—27 of FIG. 26.

The gear housing 21 is mounted on the outer axial end of the fixed length outer brace arm 34 for universal movement with a universal mounting system 146 probably seen best in FIGS. 27, 29 and 30. The universal mounting system has a first bracket 148 mounted with fasteners 150 within the gear housing on the support plate 128*a* adjacent to the motor 20 and in the space between the support plate and the motor. The first bracket 148 has a bearing sleeve 152 extending perpendicularly to the longitudinal axis of the roll bar 18. The universal mounting system has a second bracket 154 mounted within the outer end of the fixed length outer brace arm 34 by fasteners 156 on a mounting bracket 158 secured to the fixed length outer brace arm. The second bracket also has a bearing sleeve 160 that is axially aligned with the bearing sleeve 152 in the first bracket. A lag bolt that serves as a mounting shaft 162 extends through the aligned bearing sleeves to mount the gear housing 21 on the associated fixed length outer brace arm 34. A plurality of stacked washers 164 are loosely mounted on the mounting shaft between the gear housing and the fixed length outer brace arm. The openings (not seen) through the washers 164 are larger than the outer diameter of the mounting shaft 162 so that the mounting shaft can swivel within the washers allowing the gear housing to universally pivot relative to the outer end of the fixed length outer brace arm. This movement is important particularly when one support system 22 of the awning is shortened allowing one end of the roll bar 18 to tilt or incline relative to the opposite end of the roll bar which without the universal mounting would put the entire system in a strain.

Figure 4:
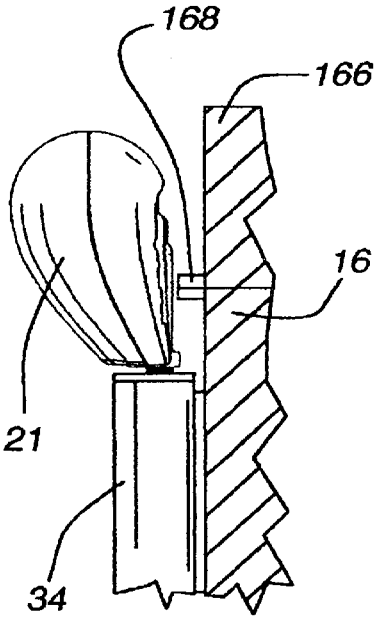
FIG. 4 is an enlarged fragmentary section taken along line 4—4 of FIG. 3.

As can be seen in FIGS. 1, 4, and 5 most recreational vehicles have a seam between the top panel 166 of the vehicle and the side panel 16 of the vehicle with the seam having a horizontal protruding rib 168 along the entire length of the vehicle which can be an obstacle when mounting retractable awnings on the vehicle. Traditionally, in order to mount an awning at the desired height, the rib 168 needed to be cut or severed to allow either a vertical mounting rail to extend thereacross or to allow the top of the awning to be retracted in closely adjacent relationship to the side wall of the vehicle. In the present invention, and as best seen in FIG. 4, the gear housing 21 is in a laterally offset relationship to the longitudinal axis of the fixed length outer brace arm 34 so that when the awning is in the retracted position of FIG. 4 or 9, the gear housing, which is horizontally aligned with the rib 168 on the vehicle, is laterally offset enough to allow the fixed length outer brace arm to move into closely adjacent relationship with the side wall 16 of the vehicle without having to sever the rib along the seam between the top and side panels of the vehicle.

Although the present invention has been described with a certain degree of particularity, it is understood that the present disclosure has been made by way of example, and changes in detail or structure may be made without departing from the spirit of the invention as defined in the appended claims.

What is claimed is:

1. A retractable awning for mounting on a support surface, said awning comprising in combination:

an awning sheet with inner and outer edges and wherein the outer edge is movable toward and away from said support surface and said inner edge is operatively secured to the support surface, a roll bar secured to one of said inner and outer edges and about which the awning sheet can be wrapped and unwrapped, a pair of scissors type support structures anchored to said support surface at one end and operatively to opposite ends of said outer edge of said awning sheet at another end and adapted to extend away from said support surface in an extended position of said awning and be adjacent to the support surface in a retracted position of the awning, said scissors-type support structures each including a pair of arms operatively secured to said support surface, and a pair of vertical guide members secured to said support surface with one of said arms being movably supported on said guide member.

2. The awning of claim 1 wherein at least one of said support structures includes a gas spring operatively anchored to said support surface and biasing the associated support structure away from said support surface.

3. The awning of claim 2 wherein said support structures include two pair of parallel arms with at least one of said arms being adjustable in length.

4. The awning of claim 3 wherein said roll bar is secured to the outer edge of said awning sheet and an outer end of said support structures are operatively connected to opposite ends of said roll bar.

5. The awning of claim 4 wherein the opposite ends of said roll bar are connected to the outer ends of said support structure with a universal mounting system.

6. The awning of claim 5 wherein said universal mounting system includes a mounting shaft supported in a loose fit spacer system between an associated end of the roll bar and the outer endof the associated support structure.

7. The awning of claim 4 further including a motor mounted on at least one end of said roll bar to selectively rotate the roll bar about its longitudinal axis.

8. The awning of claim 7 wherein at least one of said support structures includes a battery for powering said motor.

9. The awning of claim 8 wherein each of said support structures includes a vertical mounting rail on said support surface and wherein said battery is mounted in an associated vertical rail.

10. The awning of claim 1 wherein said roll bar is operatively connected to said another end of said support structures and further including gear housings interconnecting the other end of said support structures to an associated end of said roll bar, said support structure having a longitudinal axis when retracted end wherein said gear housing is laterally offset from said longitudinal axis.

11. A retractable awning for mounting on a support surface, said awning comprising in combination:

an awning sheet with inner and outer edges and wherein the outer edge is movable toward and away from said support surface and said inner edge is operatively secured to the support surface, a roll bar secured to one of said inner and outer edges and about which the awning sheet can be wrapped and unwrapped, a pair of scissors-type support structures anchored to said support surface at one end and operatively to opposite ends of said outer edge of said awning sheet at another end and adapted to extend away from said support surface in an extended position of said awning and be adjacent to the support surface in a retracted position of the awning, wherein at least one of said support structures includes a gas spring operatively anchored to said support surface end biasing the support structure away from said support surface, wherein said support structures include two pair of parallel arms with at least one of said arms being adjustable in length, wherein said roll bar is secured to the outer edge of said awning sheet and an outer end of said support structures are operatively connected to opposite ends of said roll bar, further including a motor mounted on at least one end of said roll bar to selectively rotate the roll bar about its longitudinal axis and wherein at least one of said support structures includes a battery for powering said motor, and wherein each of said support structures includes a vertical mounting rail on said support surface and wherein said battery is mounted in an associated vertical rail.

12. The awning of claim 11 wherein each support structure includes an inner brace arm having an inner end pivotally connected to said support surface, an outer brace arm having an inner end pivotally connected to an outer end of said inner brace arm and an outer end operatively connected to one end of said roll bar, an extendable brace arm vertically slidably connected to said support surface at an inner end and having an outer end, an auxiliary brace arm having an inner end pivotally connected to said outer end of the extendable brace arm and an outer end pivotally connected to said outer brace arm at an intermediate location along the length of the outer brace arm.

13. The awning of claim 12 wherein said gas spring has an inner end anchored to said support surface and an outer end connected to the inner end of said outer brace arm.

* * * * *

UNITED STATES PATENT AND TRADEMARK OFFICE

CERTIFICATE OF CORRECTION

PATENT NO. : 6,971,433 B2 
DATED : December 6, 2005
INVENTOR(S) : Robert Wagner and Garret Mauldin It is certified that error appears in the above-identified patent and that said Letters Patent is hereby corrected as shown below:

Title page,
Item [56], References Cited, U.S. PATENT DOCUMENTS, insert
-- 2,567,424 11/1951 D'Azzo --.

Column 11,
Line 43, delete "endof" and insert -- end of --.
Line 50, delete "9. The awning of claim 8 wherein each of said support structures includes a vertical mounting rail on said support surface and wherein said battery is mounted in an associated vertical rail.".

Signed and Sealed this

Twenty-eighth Day of February, 2006

JON W. DUDAS
*Director of the United States Patent and Trademark Office*